United States Patent [19]

Uroszek

[11] Patent Number: 5,002,509

[45] Date of Patent: Mar. 26, 1991

[54] TROLLING MOTOR MOUNT

[76] Inventor: Larry Uroszek, Home Ranch #10, Sheridan, Wyo. 82801

[21] Appl. No.: 386,628

[22] Filed: Jul. 31, 1989

[51] Int. Cl.[5] ..... B63H 21/26

[52] U.S. Cl. ..... 440/6; 440/49; 248/640

[58] Field of Search ..... 440/49, 53, 900, 6; 248/640, 641, 642, 643

[56] References Cited

U.S. PATENT DOCUMENTS

| | | | |
|---|---|---|---|
| 3,111,929 | 11/1963 | Fisher | 248/641 |
| 3,245,641 | 4/1966 | Hart | 248/641 |
| 3,473,764 | 10/1969 | Hopper | 248/4 |
| 3,505,971 | 4/1970 | Dalke | 440/49 |
| 3,750,988 | 8/1973 | Lyon | 248/641 |
| 3,881,443 | 5/1975 | Hamp | 248/640 |
| 4,498,872 | 2/1985 | Shonley et al. | 248/640 |

*Primary Examiner*—Sherman D. Basinger
*Assistant Examiner*—Stephen P. Avila
*Attorney, Agent, or Firm*—Brian D. Smith

[57] ABSTRACT

An outboard trolling motor mount for use in mounting an outboard trolling motor on the outboard drive unit of a boat equipped with an inboard/outboard type power unit is disclosed. The motor mount includes a mounting block for supporting an outboard trolling motor and a support structure attachable to the outboard drive unit through the drive unit's top cover for supporting the mounting block to one side of the drive unit at a location behind the boat's transom.

10 Claims, 3 Drawing Sheets

TROLLING MOTOR MOUNT

TECHNICAL FIELD

The invention relates generally to fishing trolling motors and, more particularly, to a mount for supporting small outboard fishing trolling motors on the outboard drive unit of an inboard/outboard power unit.

BACKGROUND OF THE INVENTION

Pleasure boats having inboard/outboard power units have been and are becoming increasingly popular with boaters including fishermen. Part of their popularity may be attributable to the fact that inboard/outboard power units are the preferred power unit for driving medium to larger sized boats, particularly those having a length between about 18 and 25 feet. Unlike outboard motors, inboard/outboard power units do not obstruct a boater's view from the stern of the boat, nor do they interfere with a fishermen's casting from the stern of the boat.

Despite these advantages provided by inboard/outboard power units for fishing, inboard/outboard power units are generally too powerful for trolling. Accordingly, if one desires to troll with an inboard/outboard powered boat, it is necessary in most cases to power the boat with a trolling motor.

U.S. Pat. No. 3,473,764 to Hopper discloses a trolling motor mount for use on inboard/outboard power boats. The mount is generally L-shaped and, as such, includes a generally horizontal and generally vertical arm. The horizontal arm is formed with a V-shaped recess such that the sides of the V extend on opposite sides of the outboard drive unit when the mount is secured to the drive unit. The vertical arm is attached at its lower end to the end of the horizontal arm. The vertical arm's upper free end includes a mounting block for clampingly receiving a conventional trolling motor. The motor mount is also provided with a hook-type lock bolt that hooks over a forward portion of the power unit to secure the mount to the power unit. Clamp bolts are also provided to secure the horizontal arm of the mount to the fins (or cavitation plate) of the inboard/-outboard drive unit.

While the trolling motor mount disclosed in the aforementioned Hopper patent undoubtedly works as intended, it is difficult to reach and operate a trolling motor mounted on the Hopper mount. This is because the Hopper mount is attached to the far end of the outboard drive unit which locates a motor mounted on the Hopper mount quite a distance from the boat's transom. A boat having the Hopper mount attached to it as described in the Hopper patent should also not be operated at full throttle. This is because Hopper's mount is attached to the drive unit's fins or cavitation plate which attachment would most undoubtedly interfere with steering of the boat at full throttle. This could make operation of the boat quite dangerous and it could also put a lot of strain on the cavitation plate which might damage and possibly even destroy not only the cavitation plate but possibly the entire outboard drive unit. Accordingly, it would be desirable if a trolling motor mount were available that could be mounted closer to the boat's transom for ease of use and which would not have to be removed every time it is desired to operate the boat at full throttle.

DISCLOSURE OF THE INVENTION

The present invention provides a trolling motor mount and mounting assembly for use in mounting a trolling motor on the outboard drive unit of a boat equipped with an inboard/outboard-type power unit. The mount is unique in that it is not attached to any portion of the outboard drive unit that will interfere with operation of the boat. The mount is also unique in that it locates a trolling motor mounted on the mount close to the boat's transom. As such, it is easy to install a trolling motor on the mount and easy to operate such a motor mounted thereon. It will also be appreciated that the mount itself is easy to install as will be described herein. In addition, a boat being powered by a trolling motor mounted on the mount can be steered with the boat's steering wheel. In other words, one does not have to reach out and pivot the trolling motor in order to steer the boat. Should, however, such manual-like steering become necessary, those skilled in the relevant art will appreciate that the mount's proximity to the boat's transom makes such steering of the trolling motor quite easy.

The trolling motor mount of the present invention includes a mounting block for supporting a trolling motor and support means for supporting the mounting block to one side of the outboard drive unit of an inboard/outboard power unit at a location behind the boat's transom. The support means is attachable to the outboard drive unit through the drive unit's top cover. By attaching the mount to the drive unit at this location, the boat's inboard/outboard power unit can be operated at full throttle without experiencing any steering or operational problems such as that caused by the Hopper mount. Accordingly, those skilled in the relevant art will appreciate that the mount of the present invention can be permanently installed on the outboard drive unit since there will never be any reason to remove the mount from the outboard drive unit.

The support means of the present invention includes a generally horizontal arm and a generally vertical arm which adjoin each other at a right angle. The horizontal arm has a first end for attachment to the top cover of the outboard drive unit and a second end attached to the vertical arm. The second end is generally diagonally opposed to the first end so that the second end is located to one side of the drive unit at a location which is close to the boat's transom. The vertical arm attached to the second end of the horizontal arm projects upwardly therefrom and has an upper free end which is attached to the mounting block. As such, the mounting block is elevated above the top cover of the drive unit at a location close to the boat's transom. Accordingly, a trolling motor mounted on the mount is easy to install, reach and operate.

BRIEF DESCRIPTION OF THE DRAWINGS

Other features of this invention will appear in the following description and appended claims, reference being made to the accompanying drawings forming a part of the specification where like reference characters designate corresponding parts in the views.

BEST MODE FOR CARRYING OUT THE INVENTION

Figure 1:
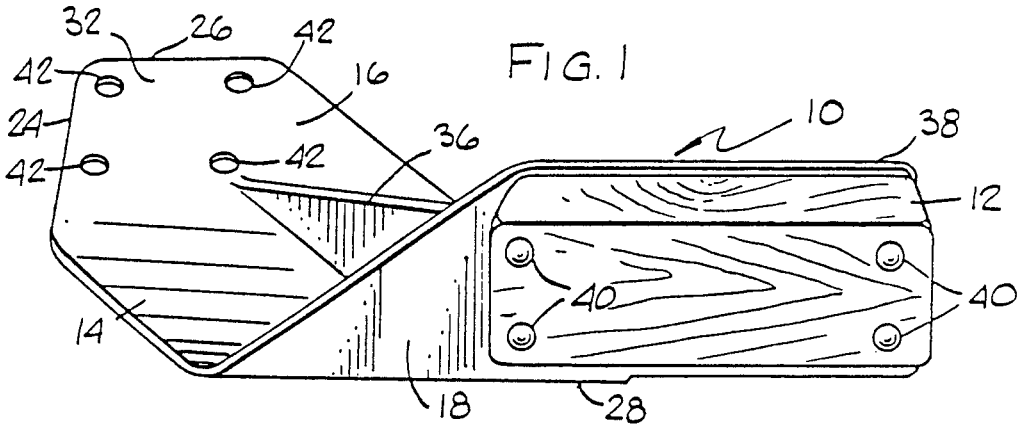
FIG. 1 is a perspective view of a trolling motor mount of the present invention.

FIGS. 1 through 8 disclose a motor mount 10 of the present invention for mounting an outboard trolling motor 11 (see FIG. 4) to the outboard drive unit 13 of an inboard/outboard-type power unit 15 through the outboard drive unit's top cover 17. Mount 10 generally includes a mounting block 12 and a support means or structure 14. Mounting block 12 is preferably made from a water-resistant wood such as teak while support means 14 is preferably made from a metal such as a high strength aluminum alloy or steel.

Figure 2:
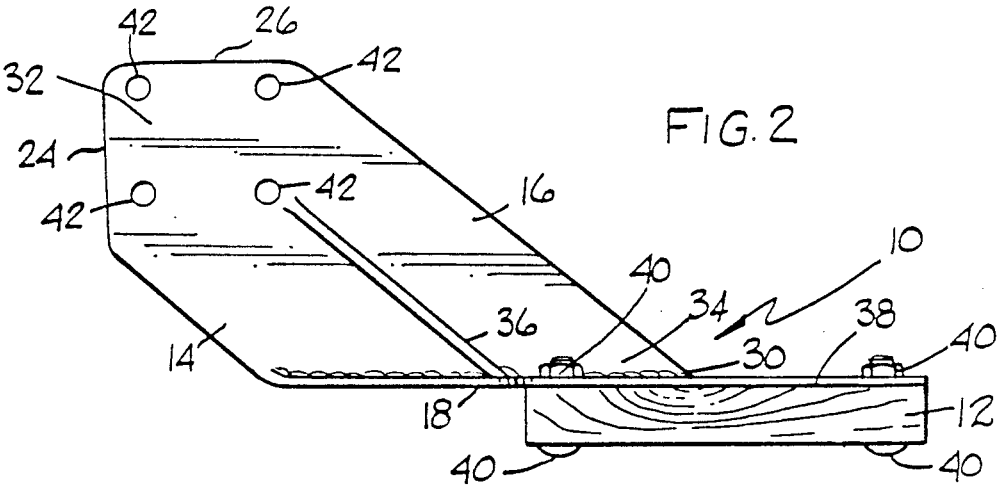
FIG. 2 is a top view of the motor mount illustrated in FIG. 1.
Figure 3:
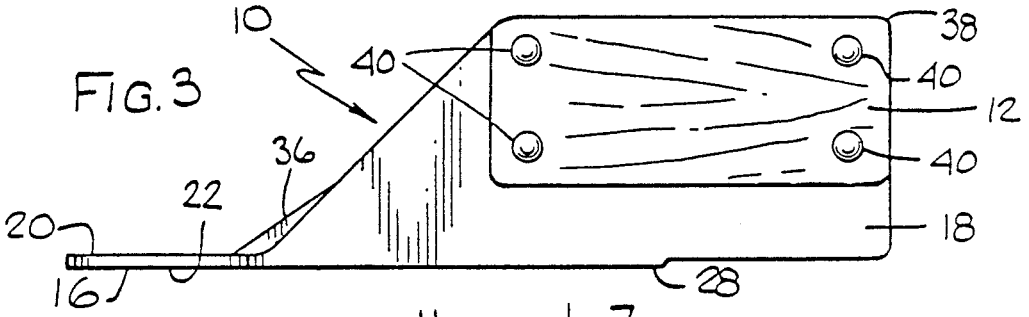
FIG. 3 is a front view of the motor mount illustrated in FIG. 1.

Support means 14 has a generally horizontal arm 16 and a generally vertical arm 18 which adjoin each other at a right angle as such is illustrated in the drawings. Horizontal arm 16 defines a generally flat upper surface 20 and a flat underside surface 22. Horizontal arm 16 also defines at least four edges 24, 26, 28 and 30 which adjoin upper and underside surfaces 20, 22. As best illustrated in FIG. 2, one end of horizontal arm 16 (referred to herein as first end 32) defines edges 24 and 26 so that these edges adjoin each other at approximately a right angle. Another end of horizontal arm 16 referred to herein as second end 34 defines edges 28 and 30 so that these edges adjoin each other at approximately a 45 degree angle.

Support means 14 is also provided with a support brace or gusset 36 which extends from first end 32 to the upper free end of vertical arm 18 which is identified by numeral 38. Gusset 36 is preferably welded to arms 16 and 18. As such, gusset 36 serves to strengthen the attachment of vertical arm 18 to horizontal arm 16. Mount 10 is also provided with four nut and bolt means 40 which attach mounting block 12 to free end 38 of vertical arm 18.

Figure 7:
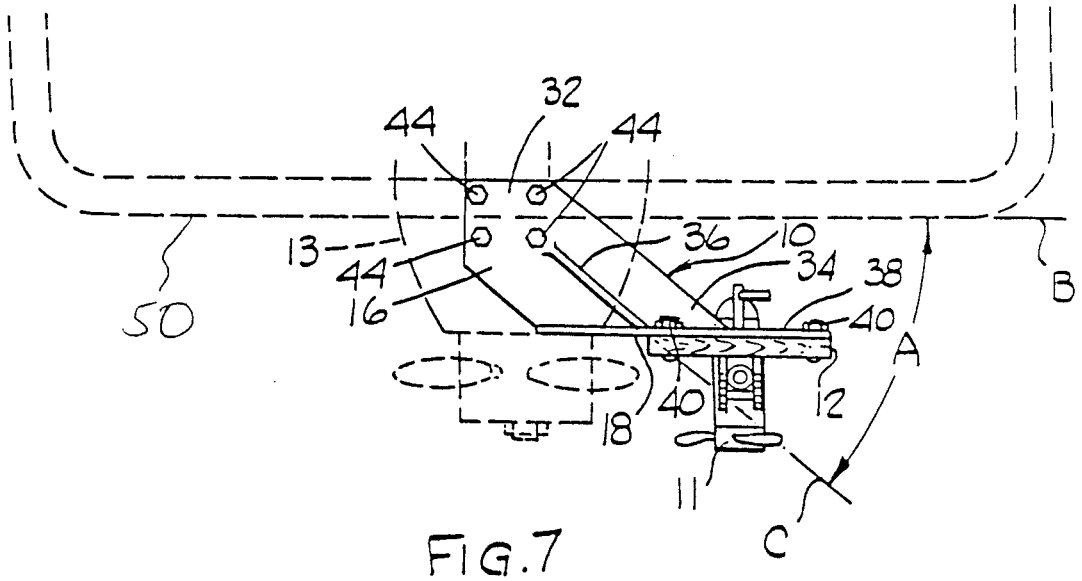
FIG. 7 is a top plan view taken along lines 7—7 of FIG. 4.
Figure 8:
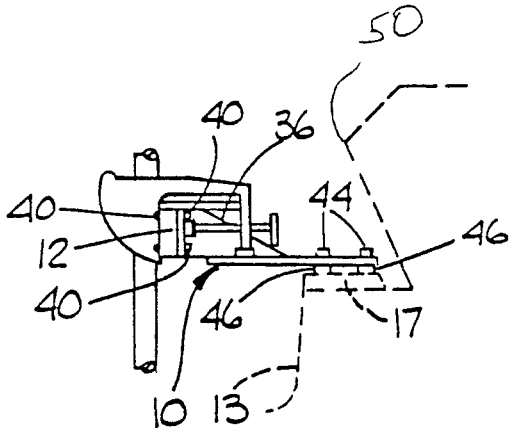
FIG. 8 is an enlarged partial view of FIG. 4 showing the means for attaching the mount to the outboard drive unit of the inboard/outboard power unit.

Turning now to the means for attaching mount 10 to drive unit 13 (also commonly referred to as the drive shaft housing) it can be seen in FIGS. 1 and 2 that first end 32 of horizontal arm 16 defines four bolt holes 42 for receiving four threaded bolts 44 (see FIG. 7). Bolts 44 secure mount 10 to the outboard drive unit, as best illustrated in FIG. 8, by extending through holes 42, spacers 46 and top cover 17 into threaded bores (not shown) already existing in outboard drive unit 13.

To install mount 10 to outboard drive unit 13, the original bolts (not shown) securing top cover 17 to the outboard drive unit are first removed. Bolts 44 which are longer than the original bolts are then inserted through holes 42, spacers 46 and existing bores (not shown) which are provided in top cover 17 for the original bolts. The exposed ends of bolts 44 which project out through top cover 17 are then threaded into the aforementioned threaded bores provided in the outboard drive unit for the original bolts. Bolts 44 are then tightened to tightly secure mount 10, spacers 46 and top cover 17 to drive unit 13. Those skilled in the relevant art will appreciate that spacers 46 tightly secure top cover 17 to the outboard drive unit by abutting up against the top cover when bolts 44 are tightened. (See FIG. 8).

Turning now to FIG. 7, those skilled in the relevant art will appreciate that support means 14, specifically horizontal arm 16, is sized and configured so that first end 32 and second end 34 generally diagonally oppose each other. As such, when mount 10 is mounted to drive unit 13 as illustrated in the drawings, second end 34 will be located to one side of the drive unit at an angle A of about 40 degrees as such is measured between a first vertical plane B and a second vertical plane C (See FIG. 7). First vertical plane B runs parallel to a top, generally horizontally extending edge 50 of the boat's transom and extends through the top cover of the drive unit. Second vertical plane C intersects the first vertical plane at approximately the geometric center of the top cover and passes through the geometric center of the mounting block. While a 40 degree angle is illustrated, angle A may range anywhere from about 0 to about 70 degrees. A trolling motor mounted on such a mount will be easy to reach and thus easily installed and operated as such is contemplated within the spirit of the present invention.

Figure 4:
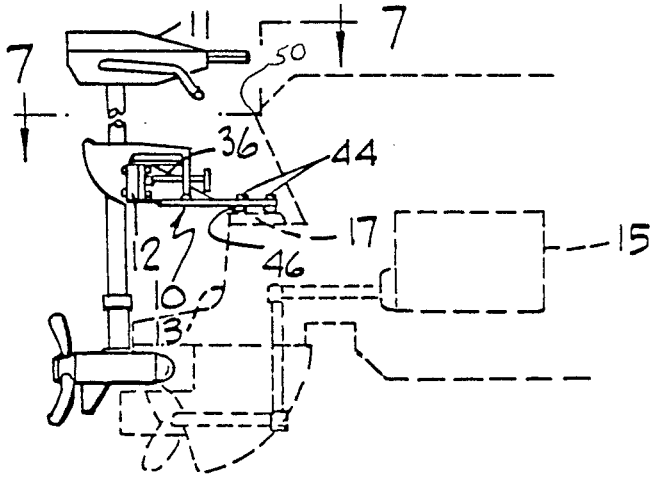
FIG. 4 is a side view illustrating an outboard trolling motor mounted on the trolling motor mount of FIG. 1 which, in turn, is mounted to the top cover of the outboard drive unit of an inboard/outboard power unit.

FIG. 4 illustrates the mounting of trolling motor 11 on mount 10 in a position suitable for trolling. Those skilled in the relevant art will appreciate that mount 10 locates trolling motor 11 close to the boat's transom, thereby making it easy to reach and operate.

Figure 5:
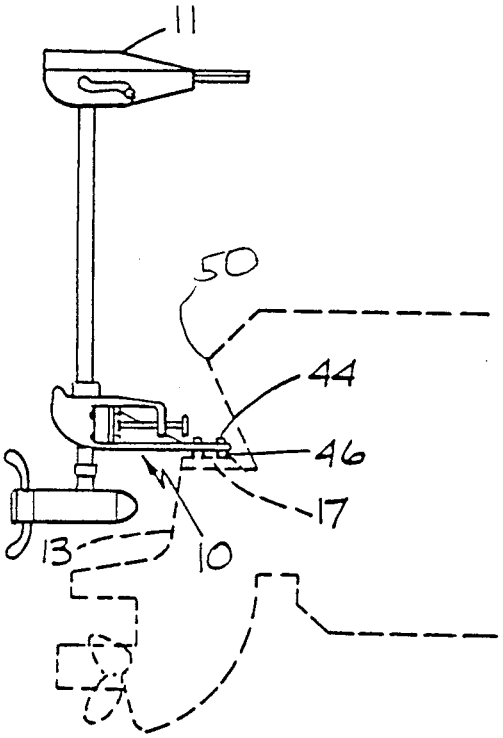
FIG. 5 is a side view illustrating the motor mount of FIG. 1 supporting a trolling motor in its raised position.

FIG. 5 illustrates the ease with which trolling motor 11 may be raised on mount 10 to lift the drive unit 46 of trolling motor 11 out of the water. While the sliding means for raising trolling motor 11 is an integral part of trolling motor 11 and not part of the present invention, those skilled in the art will appreciate that such raising and lowering of trolling motor 11 is easily accomplished with mount 10 since mount 10 locates the trolling motor close to the boat's transom, certainly much closer than that which is possible with the mount disclosed in U.S. Pat. No. 3,473,764 to Hopper.

Figure 6:
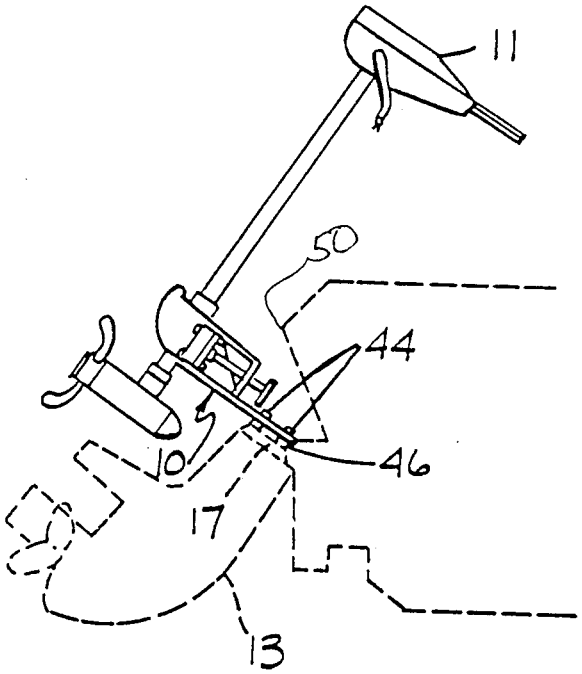
FIG. 6 is a side view similar to FIG. 5 illustrating the motor mount, the trolling motor and the outboard drive unit in a tilted position.

FIG. 6 illustrates that it is also possible to tilt outboard drive unit 13 without having to remove the trolling motor when it is mounted on mount 10 of the present invention. As such, those skilled in the relevant art will appreciate that a trolling motor can be permanently mounted on the motor mount of the present invention since boats are typically trailered and stored with the outboard drive unit in the tilted position. Moreover, should it ever become necessary to remove the mount of the present invention, those skilled in the relevant art will appreciate that such is easy with the motor mount of the present invention. One only needs to remove the four bolts 44 securing the mount to the top cover of the drive unit.

While the invention has been shown and described in detail in this application, it should be understood that this invention is not to be limited to the exact form disclosed and changes in detail and construction with regard to the disclosed embodiment may be made without departing from the spirit of the present invention.

I claim:

1. An outboard trolling motor mount for use in mounting an outboard trolling motor on the outboard drive unit of a boat equipped with an inboard/outboard type power unit, the outboard drive unit being of the type having a top cover, the boat being of the type having a transom, said motor mount comprising:

a mounting block for supporting an outboard trolling motor; and support means for solely supporting said mounting block to one side of the drive unit at a location behind the boat's transom, said support means solely supporting said mounting block by being solely attachable to the outboard drive unit through the top cover of the outboard drive unit.

2. An outboard trolling motor mount as claimed in claim 1 wherein said mounting block is supported by said support means so as to be located between a first vertical plane and a second vertical plane, said first vertical plane running parallel to a generally horizontally extending edge of the boat's transom and extending through the top cover of the drive unit, said second vertical plane intersecting said first vertical plane at the geometric center of said top cover and passing through the geometric center of said mounting block, said first and second vertical planes defining an included angle which is less than 70 degrees.

3. An outboard trolling motor mounting assembly for use in mounting an outboard trolling motor on the outboard drive unit of a boat equipped with an inboard/-outboard type power unit, outboard drive unit being of the type having a top cover, the boat being of the type having a transom, said trolling motor mounting assembly comprising:

a mounting block for supporting an outboard trolling motor;

mounting block support means for attachment to only the top cover of an outboard drive unit of an inboard/outboard type power unit, said mounting block support means including a generally horizontal arm and an adjoining generally vertical arm, said horizontal arm having a first end for attachment to the outboard drive unit through the top cover of the outboard drive unit and a second end adjoining said vertical arm at a generally right angle so as to project upwardly from said second end, said second end being generally diagonally opposed to said first end so that said second end is located to one side of the drive unit at a location behind the boat's transom when said first end is attached to said top cover, said vertical arm also having an upper free end attached to said mounting block so that said mounting block is solely supported by said support means at a location above said top cover and to the side of the drive unit at a location behind the boat's transom; and bolt means for extending through said first end and the top cover to tightly secure said mount to the outboard drive unit.

4. A trolling motor mounting assembly as claimed in claim 3 further comprising a support brace extending from said first end of said horizontal arm to said free end of said vertical arm, said support brace serving to strengthen the attachment of said vertical arm to said horizontal arm.

5. A trolling motor mounting assembly as claimed in claim 4 wherein said support brace is a gusset.

6. A trolling motor mounting assembly as claimed in claim 3 wherein said mounting block is attached to said free end of said vertical arm with bolt means.

7. A trolling motor mounting assembly as claimed in claim 3 wherein said horizontal arm defines generally flat upper and underside surfaces and at least four edges adjoining said upper and underside surfaces, said first end defining two of said edges so that said two edges adjoin each other at approximately a right angle, said second end defining the other two of said edges so that said other two edges adjoin each other at approximately a 45 degree angle.

8. A trolling motor mounting assembly as claimed in claim 3 wherein said first end defines four bolt holes for said bolt means to secure said trolling motor mount to the outboard drive unit.

9. A trolling motor mounting assembly as claimed in claim 8 further comprising four cylindrical spacers for mounting between the top cover and the underside surface of said first end of said horizontal arm and for receiving said bolt means.

10. An outboard trolling motor mounting assembly as claimed in claim 3 wherein said mounting block is supported by said support means so as to be located between a first vertical plane and a second vertical plane, said first vertical plane running parallel to a generally horizontally extending edge of the boat's transom and extending through the top cover of the drive unit, said second vertical plane intersecting said first vertical plane at the geometric center of said top cover and passing through the geometric center of said mounting block, said first and second vertical planes defining an included angle which is less than 70 degrees.

* * * * *